United States Patent [19]

Gullichsen

[11] Patent Number: 4,754,935

[45] Date of Patent: Jul. 5, 1988

[54] METHOD AND APPARATUS FOR REFINING FIBROUS MATERIAL

[75] Inventor: Johan Gullichsen, Sjundeå , Finland

[73] Assignee: Kamyr AB, Karlstad, Sweden

[21] Appl. No.: 37,005

[22] Filed: Apr. 10, 1987

[30] Foreign Application Priority Data

Apr. 10, 1986 [SE] Sweden ..... 8601606

[51] Int. Cl.[4] ..... B02C 19/12

[52] U.S. Cl. ..... 241/24; 241/28; 241/79.1; 241/259.1; 241/261.1

[58] Field of Search ..... 162/23; 241/261.2, 37, 241/261.3, 261.1, 259.1, 259.2, 93, 28, 24, 293, 294, 245, 247, 79.1

[56] References Cited

U.S. PATENT DOCUMENTS 3,815,834 6/1974 Gilbert .
4,401,280 8/1983 Reinhall .

FOREIGN PATENT DOCUMENTS 901857 6/1972 Canada .
1079559 6/1980 Canada .
8105217 9/1981 Sweden .
2083375 3/1982 United Kingdom .

OTHER PUBLICATIONS

Salmen, N. L. and Fellers, C., "The Fundamentals of Energy Consumption During Viscoelastic and Plastic Deformation of Wood", Trans. Tech. Sec. (Can. Pulp Pap. Ass.) 9 (4):TR 93 (1982).

Salmen et al., "Fatigue of Wood—Characterization of Mechanical Defibration", J. Pulp Pa. Sci. 11 (3):J 68 (1985).

Atack, D., "Fundamental Differences in Energy Requirement . . . ", Sven. Papperstidn. 84 (14):22 (1981).

Pearson, A. J., "Towards a Unified Theory of Mechanical Pulping . . . ", Paper presented at 1983 Mechanical Pulping Conf. Wash., D.C., Jun. 14, 1983.

*Primary Examiner*—Mark Rosenbaum
*Attorney, Agent, or Firm*—Nixon & Vanderhye

[57] ABSTRACT

A refiner has a frusto-conically shaped grinding zone located between an outer housing and an inner frusto-conical rotor. The rotor has suitable openings for removing steam from the grinding zone inwardly into an interior chamber within the rotor. Multiple separation stages are provided in the rotor and between it and the housing, respectively, whereby separation of the steam and any following fibrous material particles is effected. By removing the steam from the grinding zone, increased retention time of the fibrous material in the grinding zone and increased production is effected.

20 Claims, 2 Drawing Sheets

FIG. 2
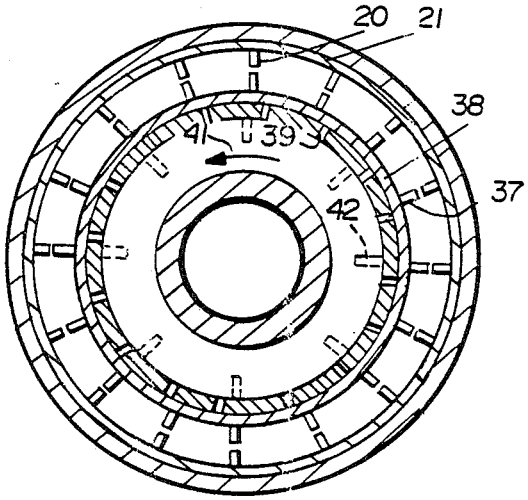
FIG. 3
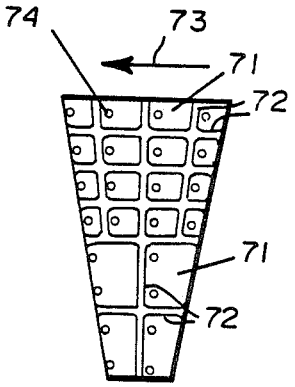
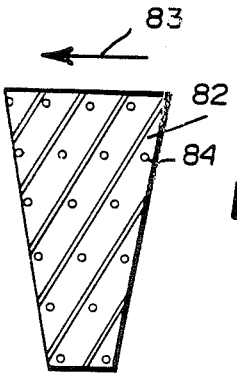
FIG. 4

METHOD AND APPARATUS FOR REFINING FIBROUS MATERIAL

BACKGROUND AND SUMMARY OF THE INVENTION

The present invention relates to the refining of fibrous material, such as wood chips, and particularly relates to novel and improved methods and apparatus for refining comminuted fibrous chips, e.g., refining chips to pulp according to thermomechanical pulping (TMP), chemimechanical pulping (CMP), and chemithermomechanical pulping (CTMP) or other methods for the production of high-yield or mechanical pulps.

In mechanical pulping, chips are broken down into progressively smaller chips or pulp using a refiner, i.e., a defibrator. Typically, a refiner or defibrator includes relatively movable grinding surfaces defining a grinding zone therebetween wherein chips are reduced to form pulp. These grinding surfaces, for example, may comprise oppositely disposed discs or conical surfaces and are relatively rotated by an electric motor. In areas where electrical costs are high, the cost of operating the refiner can be prohibitive. For example, the energy conversion can be on the order of magnitude of approximately 1000 kWh per ton of pulp.

It has been recognized that only a small portion or fraction of this electrical energy is used to defibrate the chips. The major portion of the energy is used to convert the moisture in the fibrous material, as well as any liquid added in the defibration process, into steam. Steam, however, undesirably occupies the majority of the space within the grinding zone. The presence of steam in the grinding zone is undesirable because it inhibits the natural passage of the fiber material through the grinding zone and decreases the retention time of the fibrous material in the grinding zone.

In previously filed U.S. patent application Ser. No. 8,667 filed Jan. 30, 1987, now abandoned, and in copending application Ser. No. 70,212 filed July 6, 1987, the problem of reducing the energy costs in refiners of this type is addressed. In such applications, there is described a method for lowering energy consumption during refining of fibrous material by decreasing the grinding frequency through a reduction of the number of cutting elements on the grinding surfaces. This, in turn, increased the fiber material retention time in the grinding zone. Using cylindrical or frusto-conical grinding zones as well as removing a substantial portion of the steam from the grinding zone further improved the fiber material retention time.

According to the present invention, there is provided a refiner apparatus wherein the grinding zone is defined between a pair of cylindrical or preferably frusto-conical grinding surfaces wherein the fiber material retention time in the grinding zone is increased by the removal of an increased quantity of the steam produced in the grinding zone in a simple, efficient and practical manner. In a manner to be explained, the steam generated in the grinding zone is removed such that the available volume in the grinding zone for refining material is increased and the volume occupied by the steam is substantially decreased and minimized. The removal of increased quantities of steam is accomplished efficiently and in such manner that fibrous particles following the steam in the process of its removal from the grinding zone are passed through a multi-stage separation process. This multi-stage separation is accomplished within the confines of the refiner itself, using the rotary action of the refiner rotor to achieve separation of the removed steam and any fibrous material particles following the steam during its removal. Thus, the multi-stage separation process may comprise a pair of centrifugal separators using the rotor of the refiner as the driving force for effecting separation and with the parts thereof arranged to effectively recombine the fibrous materials removed from the separation stage with the fiber material outlet of the grinding stage. The steam is therefore removed in a relatively clean condition without the necessity of additional cyclones or other separation apparatus.

According to one aspect of the present invention, there is provided apparatus for refining fibrous material including a housing having a first grinding surface, a rotor carried by the housing for rotation about an axis and having a second grinding surface, the grinding surfaces defining a grinding zone therebetween, and means for rotating the rotor. The housing includes an inlet to the grinding zone for receiving coarse fibrous material, such as wood chips, and an outlet from the grinding zone for removing ground fibrous material. A centrifugal separator is carried by the rotor and includes an interior chamber defined by the rotor and disposed inwardly of the second grinding surface. Means are carried by the rotor for removing steam generated in the grinding zone and directing the steam inwardly of the rotor into the chamber. The separator has a fibrous material particles outlet and a steam outlet in communication with the chamber. Steam and any fibrous material particles contained therein and following the steam from the grinding zone into the chamber are separated one from the other in the separator by centrifugal action for flow through the steam outlet and the separate particles outlet, respectively. Preferably, the steam removal means includes a plurality of openings formed in grinding segments mounted on the surface of the rotor for directing the steam from the grinding zone inwardly into the chamber. The chamber is in part defined by the inside wall of the rotor and has a plurality of circumferentially spaced ribs for directing the separated fiber material particles through an outlet adjacent the end of the rotor in communication with the outlet for the fiber material from the grinding zone.

Preferably, a second-stage separation is also provided and which lies in communication with the steam outlet from the chamber of the first separation stage. The second separation stage includes a separation zone between the rotor and the housing inwardly of the chamber and ribs carried on an inside surface of the rotor wall for directing fibrous material particles to the previously mentioned particle outlets.

It is also a feature of the present invention that the grinding zone may be increased or decreased in width in a relatively simple, practical and efficient manner. Particularly, the housing includes end parts mounting an intermediate part therebetween for axial displacement, the intermediate part carrying the inwardly directed grinding surfaces in opposition to the grinding surfaces of the rotor. The intermediate part is thus axially displaceable, for example, by means of a hydraulic cylinder, to increase or decrease the spacing between the grinding surfaces of the intermediate part and the rotor.

In a still further embodiment of the present invention, there is provided a method of refining fibrous material including the steps of grinding the fibrous material in the grinding zone between the grinding surfaces whereby steam and fibrous material particles are generated in the grinding zone, flowing at least a portion of the steam and fibrous material particles following the steam through openings in the rotor into an interior chamber formed by the rotor, separating the particles in the steam in a first separation stage in the chamber, flowing at least a portion of the steam and following fibrous material particles from the first separation stage into a second separation stage which is, in part, formed by a rotatable surface of the rotor and separating the particles and steam in the second separator stage.

Accordingly, it is a primary object of the present invention to provide novel and improved apparatus and methods for refining fibrous material which effectively reduces the energy costs of converting the fibrous material to pulp by effectively and efficiently removing steam from the grinding zone to increase fiber material retention time in the grinding zone and to separate from the removed steam any following steam particles for recombination with the ground fiber material at its outlet and providing clean steam.

These and further objects and advantages of the present invention will become more apparent upon reference to the following specification, appended claims and drawings.

BRIEF DESCRIPTION OF THE DRAWING FIGURES

FIG. 2 is a cross-sectional view thereof taken generally about on line A—A of FIG. 1; and FIGS. 3 and 4 show two examples of grinding segments usable with the rotor which forms a part of the refiner apparatus illustrated in FIG. 1.

DETAILED DESCRIPTION OF THE DRAWING FIGURE

Figure 1:
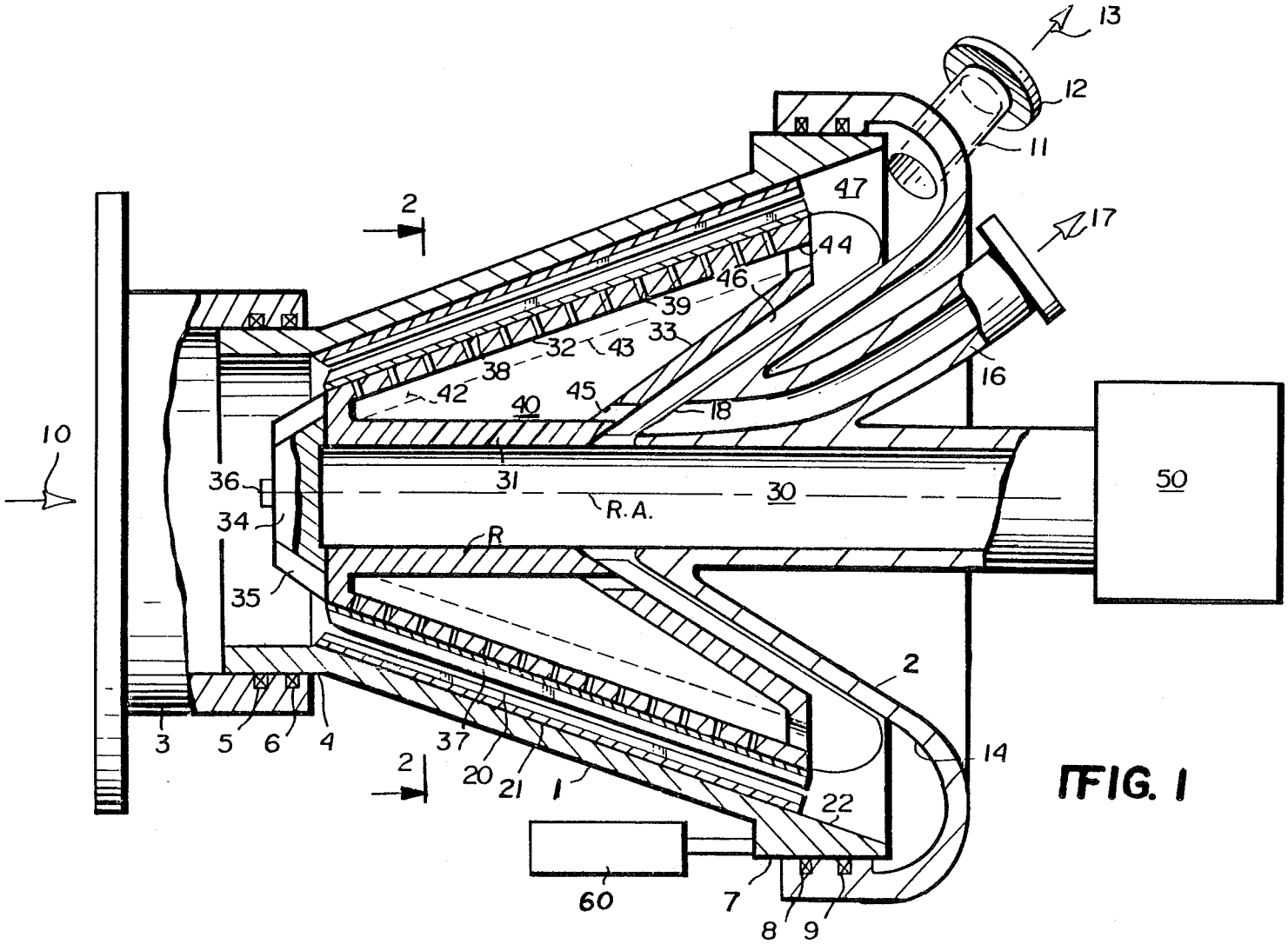
FIG. 1 is a longitudinal cross-sectional view through a refiner constructed in accordance with the present invention.

Reference will now be made in detail to the drawings hereof, which illustrate a preferred embodiment of the present invention.

Referring now to FIG. 1, there is illustrated a refiner, constructed in accordance with the present invention and including a housing having three principal parts, a frusto-conical intermediate part 1, a rear end part 2, and an opposite end inlet part 3. Intermediate housing part 1 has at its forward end a cylindrical section 4 which is received in the cylindrical inlet part 3 for axial sliding movement, suitable packing or sealings, for example, O-rings 5 and 6 being provided in part 3. Similarly, the larger end 7 of the frusto-conical intermediate part 1 is received in a generally cylindrical housing formed on end part 2, the housing being provided with suitable packings or sealing rings, such as O-rings, indicated 8 and 9. With this arrangement, it will be appreciated that the inlet part 3 has an end opening so that fibrous material, for example, wood chips, may flow into the apparatus as indicated by the arrow 10. A ground fibrous material outlet 11 is provided at the opposite end of the housing and terminates in a flange 12 for facilitating connection to a pipe or similar conduit through which treated fiber material indicated by the arrow 13, may leave the refiner. While outlet 11 is illustrated at an angular relation relative to the axis of the housing, outlet 11 may be arranged tangentially in relation to the rotor axis RA and an additional one or more outlets may be provided about the periphery of end housing part 2.

On the inner surface of the frusto-conical intermediate housing part 1, there is provided a plurality of grinding ribs 20. Ribs 20 are fastened to or form a part of a grinding segment 21 releasably secured to the housing part 1. It will be appreciated that grinding segment 21 is a conical segment which is received within and suitably secured to intermediate housing part 1, it being appreciated that a plurality of such parts may be provided.

Housing end part 2 has a frusto-conically shaped surface 14, as well as a cylindrical surface 15, which surrounds a rotor shaft 30. Frusto-conical surface 14 also has an outlet 16 for removing substantially clean steam from the refiner, as indicated by the arrow 17. Steam outlet 16 has an opening 18 for receiving steam from the separation stages, to be discussed, and it will be appreciated that additional steam outlets may be provided about the axis R.A. in substantially the same relation as shown with respect to outlet 16 but at different circumferential locations.

Mounted on shaft 30 is a rotor designated R which includes a central cylindrical sleeve 31 secured to shaft 30 and a frusto-conical outer sleeve or mantle 32 spaced from, but having about the same conicity, as intermediate housing part 1. Rotor R also has a frusto-conically shaped rear wall 33 that has about the same conicity as the housing back wall or surface 14. At the front part of the rotor, there is provided an inlet boss 34 having a plurality of ribs or blades 35 spaced around its circumference and fastened to the shaft 30 by means of a screw 36.

Similarly as the interior of intermediate part 1 is provided with segments 21 of mounting ribs 20, the frusto-conical sleeve or mantle 32 is provided a plurality of grinding ribs 37 which are secured to one or more grinding segments 38, in turn, secured to surface 37 of rotor R. Grinding ribs 37 substantially parallel grinding ribs 20 and it will be appreciated that grinding ribs 20 and 37 define a frusto-conical grinding zone therebetween. To rotate shaft 30 and rotor R, a suitable drive 50 is coupled to shaft 30 to effect rotation.

It is a significant feature of the present invention that rotor R has a plurality of axially spaced radially inwardly directed openings or holes 39 which communicate between the grinding zone and a chamber 40 defined by the inner surfaces of the frusto-conical wall 32, cylindrical sleeve 31 and rear wall 33. Chamber 40 is thus an interior annular chamber within rotor R. Openings 39 are located with respect to ribs 37 such that they are located in the rotating shadow of the ribs, i.e., adjacent the side of the ribs where the pressure in the suspension in the grinding zone is the lowest. This is best illustrated in FIG. 3, where the longitudinally extending ribs 72 are shown with the openings 74 located just to the right of the ribs in a low pressure zone, the direction of rotation of the segment and rotor being illustrated by the arrow 73.

Referring back now to FIGS. 1 and 2, the interior surface of wall 32 is provided with a plurality of circumferentially spaced, generally axially extending ribs 42 indicated by the dashed lines in those Figures. Adjacent the rear end of rotor R and where wall 32 meets rear wall 33, there is provided a plurality of circumferentially spaced openings 44. On the inside surface of end wall 33, there is provided a plurality of circumferentially spaced ribs 46, which extend axially past openings 44 and into an annular channel 47 in communication with ground fibrous material outlet 11. Thus, it will be appreciated that the outlet from the grinding zone, the outlets 44 and the outlet from the zone between end wall 33 of rotor R and end wall 14 of housing part 2 all terminate or open into annular chamber 47.

The grinding segments 21 carried by the housing and grinding segments 38 carried by the rotor may be divided into a plurality of parts which facilitate their replaceability. For example, each part can have substantially the same length as the housing but only a small part, for example 1/6, of its circumference. Also, as illustrated in FIG. 3, the ribs and openings 74 through the segments may be varied upon the desired end result. For example, the rib and opening pattern illustrated in FIG. 3 is comprised of a plurality of depressed areas 71 enclosed by both axially and radially extending ribs 72. With the direction of rotation illustrated at 73, it will be appreciated that the openings 74, which lie in registry with the openings 39 through rotor wall 32, are disposed on the low pressure side of the axial ribs.

In FIG. 4, the rib and hole pattern is somewhat different, with ribs 82 extending generally axially but at an angle relative thereto. The openings 84 are similarly disposed, as in the prior embodiment, on the low pressure side of the ribs 82.

Thus, the front side of the ribs, i.e., adjacent the leading edge of the ribs, are in the area of high pressure. The pressure on the back side of the ribs, in the area of the openings, is at a lower pressure but a pressure which is greater than the pressure inside chamber 40. Additionally, the size and number of the openings 74 and 84 through the grinding segments can be varied within the grinding zone so that additional or fewer openings may be provided in the areas of the grinding zone where the steam production is the greatest or the least, respectively. In most cases, the openings would therefore be clustered in those parts of the rotor which have the greatest diameter, i.e., towards the rear end of the rotor, as illustrated in FIG. 1, where the peripheral velocity is the greatest and also where the distance between the grinding ribs is the least.

The grinding frequency depends upon the speed of revolution of the rotor and the number of ribs or cutting elements provided on the rotor. Normally, a rotor speed of 1,000–1,500 rpm is used which, when multiplied by a conventional number of ribs, gives frequencies on the order of 6,000–20,000 Hz. In contrast, the rotor speed and number of ribs of the present invention are such that frequencies of 300–800 Hz are obtained. This is achieved primarily by decreasing the number of cutting elements or ribs in the housing and on the rotor from 400–600 to 20–30.

As explained earlier, a substantial part of the steam generated in the grinding zone from the refining of fibrous material and through the decrease in grinding frequency, is removed from the grinding zone. Thus, according to the present invention, an average fiber retention time within the grinding zone of about 1.2 seconds may be achieved. This, on average, is about 200 times longer than in a conventional disc refiner. This, in turn, substantially reduces the energy required to drive the refiner to about half per ton of pulp production, as compared with previous refiners.

In use, coarse fibrous material, for example wood chips 10, are disposed into the housing through inlet part 3, for example by means of a feeding screw, not shown, the material being distributed about the rotor by means of blades 35. By virtue of the feeding pressure of the screw and due to the centrifugal force in the grinding zone, the fibrous material moves from left to right in FIG. 1 from the smaller diameter inlet of the grinding zone to the larger diameter outlet end of the grinding zone. During that axial passage, the fibrous material is subjected to grinding in the grinding zone as the rotor rotates relative to the housing intermediate part 1. That action causes the water or liquid in the chips, and any additional liquid which may be added for treatment purposes, to generate steam in the grinding zone. Such steam will tend to occupy the greatest part of the available volume in the grinding zone. Thus, it is critical to separate or remove substantial quantities of the steam from the fiber material in the grinding zone.

In accordance with the present invention, the steam passes substantially radially inwardly through the openings in the grinding segments and rotor wall 32 into interior chamber 40. It will be appreciated that notwithstanding the separating action between the steam and the fibrous materials being ground by virtue of the centrifugal action in the grinding zone, particles of the fibrous material will follow the steam through such openings into the interior chamber 40. The size and number of the openings are such that the steam velocity inwardly through the holes will not be sufficiently great that substantial quantities of fiber material will follow the steam. As indicated, the ground fibrous material from the grinding zone moves axially into channel 47, where it is removed through outlet 11.

The principal portion of the steam generated in the grinding zone, with any following fibrous material particles, is disposed in chamber 40. Chamber 40 constitutes a first separation stage wherein the steam and following particles are separated by centrifugal action. Thus, the heavier fibrous material particles are directed radially outwardly against the inside surface of wall 32 where, in conjunction with ribs 42, such particles flow outwardly through outlet 44 into channel or chamber 47. The steam within chamber 40, however, exits through steam outlets 45. It will be appreciated from a review of drawing FIG. 1 that chamber 40 is a relatively large volume chamber such that the flow velocity of the steam within the chamber is substantially reduced. Thus, rather than leaving chamber 40 through outlets 44, the steam at reduced velocity flows out through the openings 45. Thus, the size and centrifugal action of the rotor in chamber 40 effects a positive separation of the steam and fibrous material particles in this first separation stage.

Steam issuing through openings 45 and any fibrous material particles following the steam which remain after the first separation, undergo a second separation in the area between the rotor and the housing end wall 14. Thus, the centrifugal action of the rotor causes the fibrous material particles issuing from outlets 45 with the steam to flow axially and radially outwardly along ribs 46 for reception in channel 47. Steam, however, continues through the openings 45 and into the inlet 18 of steam outlet 16. It will be seen that the two separation stages provide additive fibrous material particles to the ground fiber issuing from the grinding zone into chamber 47 for flow through fiber outlet 11. Also, the steam removed from the grinding zone and the two separation stages flows through a common steam outlet 16. Such steam is passed through the two separation stages in the form of clean steam.

It is a significant feature of the present invention that the spacing between the rotor and housing in the area of the grinding zone may be adjusted. To accomplish this, a hydraulic cylinder 60 is provided in operative relation to the intermediate part 1 such that the latter can be displaced axially whereby the grinding surfaces formed by ribs 20 may be displaced toward or away from the ribs 37 of the rotor. Thus, with this arrangement, none of the fixed parts of the system need to be disconnected or shifted during adjustment. Additionally, the slot in the second separation stage between the housing end part 2 and the ribs 46 is kept constant, even if the grinding slot is varied. Thus, the second-stage separation remains effective.

It will be appreciated that the openings through the grinding segments and the rotor wall may take various forms. For example, such openings may slant inwardly instead of extending in a radial direction or they may be shaped, for example, conically.

Thus, it will be appreciated that the objects of the present invention have been fully accomplished in that there has been provided a novel and improved refiner which substantially reduces the electrical power requirements, increases the retention time of the fibrous material in the refiner and thereby the production capacity of the ground fibrous material, by removing substantial increased quantities of steam from the grinding zone, thus making the way for additional fibrous material input to the grinding zone. Moreover, a multistage separation of the removed steam and any following fibrous materials is efficiently effected by making use of the centrifugal action of the rotor necessary to effect grinding in the grinding zone. Thus, the steam can leave the refiner in a relatively clean condition. It will also be appreciated that the pressure difference between the fiber material outlet 11 and the steam outlet 16 can be controlled such that optimal operational results can be achieved.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of refining fibrous material using an apparatus having surfaces of revolution carrying inner and outer grinding surfaces defining a grinding zone therebetween having an inlet and an outlet, at least the surface of revolution carrying one grinding surface being rotatable about its axis of revolution relative to the other surface, the rotatable surface of revolution having openings opening into a chamber formed by said rotatable surface of revolution, comprising the steps of:

grinding the fibrous material in the grinding zone between the grinding surfaces so that steam and fibrous material particles are generated in the grinding zone;

flowing at least a portion of the steam and fibrous material particles following the steam portion through the openings in the rotatable surface of revolution into the chamber;

centrifugally separating the particles and steam in first separation stage in the chamber;

flowing at least a portion of the steam and following fibrous material particles from the first separation stage into a second separator stage in part formed by the rotatable surface of revolution; and centrifugally separating the particles and steam in the second separator stage.

2. A method according to claim 1 wherein the chamber defined by said rotatable surface of revolution has first and second outlets spaced at different radial positions relative to the axis of revolution, respectively, and including the step of flowing at least a portion of the particles separated in said first separation stage through said first outlet and flowing the steam and the remaining fibrous material particles following the steam through said second outlet.

3. A method according to claim 1 wherein the centrifugal separation of the particles and steam in said first and second separation stages is accomplished by the centrifugal action caused by rotation of said surface of revolution.

4. A method according to claim 1 wherein the surfaces of revolution are frusto-conical and define a frusto-conically shaped grinding zone therebetween, the rotatable surface of revolution having an inner surface diverging from one end to the other in the direction of flow, including the step of flowing the particles undergoing separation in said first separation stage along said inner surface by centrifugal action caused by the rotating surface of revolution.

5. A method according to claim 4 including the step of adjusting the width of the grinding zone by displacing the rotational surface of revolution in an axial direction.

6. A method according to claim 4 including flowing the fibrous particles separated in said first and second separation stages to said grinding zone outlet and flowing the steam separated from said second separation stage out of the apparatus.

7. Apparatus for refining fibrous material comprising:

a housing having a first grinding surface;

a rotor carried by said housing for rotation about an axis and having a second grinding surface, said grinding surfaces defining a grinding zone therebetween;

means for rotating said rotor;

means carried by said housing defining an inlet to said grinding zone for receiving fibrous material and an outlet from said grinding zone for removing ground fibrous material;

a centrifugal separator means associated with said rotor including an interior chamber defined by said rotor and disposed inwardly toward said axis of rotation of said second grinding surface, for centrifugally separating steam and fibers;

removing means carried by said rotor for removing steam generated in said grinding zone and directing the steam inwardly of said rotor into said interior chamber; and said separator means having a fibrous material particles outlet and a steam outlet in communication with said interior chamber so that steam and any fibrous material particles contained therein and following the steam through said removing means are separated one from the other in said separator means by centrifugal action for flow through said steam outlet and said separator particles outlet, respectively.

8. Apparatus according to claim 7 wherein said centrifugal separator constitutes a first separation stage, and means defining a second separation stage in communication with said steam outlet for separating the steam passing through said outlet and any fibrous material particles contained therein one from the other.

9. Apparatus according to claim 8 wherein said second separation stage includes a separation zone disposed between said rotor and said housing inwardly toward said axis of rotation of said interior chamber.

10. Apparatus according to claim 7 wherein said first and second grinding surfaces are frusto-conical in shape to define a frusto-conical grinding zone therebetween, said steam removing means including a plurality of openings through said rotor in communication with said chamber.

11. Apparatus according to claim 10 wherein said inlet is disposed adjacent the small diameter end of said frusto-conical grinding zone, said particle outlet from said first separator being disposed adjacent to and inwardly of the outlet from said grinding zone and radially outwardly of said steam outlet.

12. Apparatus according to claim 10 wherein said rotor has an inside frusto-conical wall surface defining a portion of said chamber, and a plurality of inwardly directed circumferentially spaced ribs projecting from said inside wall surface.

13. Apparatus according to claim 10 wherein said second separation stage includes a separation zone disposed between said rotor and said housing inwardly of said chamber, said second separation zone being defined, in part, by a conically shaped wall carried by said rotor and having a plurality of inwardly extending and circumferentially spaced ribs.

14. Apparatus according to claim 13 including an annular chamber downstream of said grinding zone for receiving the ground fibrous material from said grinding zone, said separator particles outlet lying in communication with said annular chamber, said second separation stage having a fibrous material particles outlet in communication with said annular chamber, and means defining a steam outlet from said second separation stage in communication with said separation zone and disposed radially inwardly of said annular chamber.

15. Apparatus according to claim 7 wherein at least one of said first and second grinding surfaces is formed of a plurality of discrete grinding segments removably secured to one of the corresponding housing and rotor.

16. Apparatus according to claim 15 wherein said removing means comprises openings through said segments and rotor in registration one with the other and extending generally in a radial direction.

17. Apparatus according to claim 16 wherein said one rotor mounts said plurality of discrete segments, each said segment having a plurality of spaced ribs projecting from its surface in a generally axial direction, said openings through said segments being disposed between said ribs and located distances from the leading rib in the direction of rotation smaller than the distance between said openings and the trailing rib in the direction of rotation.

18. Apparatus according to claim 16 wherein said grinding surfaces are frusto-conical in shape, said openings being disposed throughout the length of said frusto-conical segments, the number of openings per unit length of said segments being different at different axially spaced locations along said rotor.

19. Apparatus according to claim 10 wherein said rotor openings adjacent the outlet are circumferentially spaced one from the other a distance less than the circumferential distance between said openings adjacent the inlet.

20. Apparatus according to claim 10 wherein said housing includes end parts on opposite ends of an intermediate part carrying said grinding surfaces, said intermediate part being axially displaceable relative to said end parts, and means for axially displacing said intermediate part so that the width of the grinding zone between the housing and the rotor can be adjusted.

* * * * *